US010945486B2

(12) United States Patent
Ito et al.

(10) Patent No.: US 10,945,486 B2
(45) Date of Patent: Mar. 16, 2021

(54) SOLE STRUCTURE AND SHOE INCLUDING SAME

(71) Applicant: MIZUNO CORPORATION, Osaka (JP)

(72) Inventors: Kouji Ito, Osaka (JP); Shin Hirai, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 265 days.

(21) Appl. No.: 16/292,672

(22) Filed: Mar. 5, 2019

(65) Prior Publication Data

US 2019/0281920 A1 Sep. 19, 2019

(30) Foreign Application Priority Data

Mar. 14, 2018 (JP) ..... JP2018-046730

(51) Int. Cl.

| | |
|---|---|
| ***A43B 3/26*** | (2006.01) |
| ***A43B 13/04*** | (2006.01) |
| ***A43B 13/14*** | (2006.01) |
| ***A43B 7/14*** | (2006.01) |
| *A43B 5/00* | (2006.01) |

(52) U.S. Cl.

CPC ..... *A43B 3/26* (2013.01); *A43B 7/1465* (2013.01); *A43B 13/04* (2013.01); *A43B 13/141* (2013.01); *A43B 5/00* (2013.01)

(58) Field of Classification Search

CPC ..... A43B 3/26; A43B 7/1465; A43B 13/04; A43B 13/141; A43B 5/00

USPC ..... 36/97

See application file for complete search history.

(56) References Cited

U.S. PATENT DOCUMENTS

| | | | | |
|---|---|---|---|---|
| 5,729,912 | A * | 3/1998 | Gutkowski | A43B 3/26 36/93 |
| 6,138,385 | A * | 10/2000 | Jungkind | A43B 1/0018 36/102 |
| 9,271,541 | B2 * | 3/2016 | Biancucci | B29D 35/061 |
| 2002/0088145 | A1 * | 7/2002 | Clark | A43B 13/181 36/97 |
| 2004/0107604 | A1 * | 6/2004 | Ha | A43B 3/26 36/97 |
| 2005/0257405 | A1 * | 11/2005 | Kilgore | A43B 13/141 36/97 |
| 2008/0244929 | A1 * | 10/2008 | Garcia-Perez Aradros | A43B 1/0018 36/88 |
| 2010/0175277 | A1 * | 7/2010 | Langvin | A43D 5/00 36/97 |

(Continued)

*Primary Examiner* — Ted Kavanaugh

(74) *Attorney, Agent, or Firm* — Troutman Pepper Hamilton Sanders LLP; James E. Schutz; Micah B. Hensley

(57) ABSTRACT

A sole body includes a groove whose inner wall surfaces can be caused to come close to, and separate from, each other with an adjustment mechanism, and a transformable portion provided in the groove, extending between the inner wall surfaces, and elastically deformable. The transformable portion includes: rising portions which are continuous with the inner wall surfaces and extend in the thickness direction of the sole body while the inner wall surfaces have come close to each other; and a coupling portion for coupling the rising portions to each other at one end. A first cavity is provided between the inner wall surfaces and the rising portions, while a second cavity is provided between the rising portions.

6 Claims, 9 Drawing Sheets

(56) References Cited

U.S. PATENT DOCUMENTS

| | | | | |
|---|---|---|---|---|
| 2017/0188655 | A1 | 7/2017 | Carlson et al. | |
| 2019/0281922 | A1* | 9/2019 | Ito | A43B 7/1425 |

* cited by examiner

SOLE STRUCTURE AND SHOE INCLUDING SAME

CROSS-REFERENCE TO RELATED APPLICATION

This application claims priority to Japanese Patent Application No. 2018-046730 filed on Mar. 14, 2018, the entire disclosure of which is incorporated by reference herein.

BACKGROUND

The present disclosure relates to a sole structure and a shoe including such a sole structure.

A shoe sole structure of which a length of the sole body in the foot width direction is adjustable by an adjustment mechanism has been known. For example, U.S. Patent Application Publication No. 2017/0188655 proposes a sole structure of this type.

This patent document discloses a sole structure for a shoe, the sole structure including a sole body made of an elastic material, and an adjustment mechanism provided in an intermediate portion of the sole body in the thickness direction, and capable of adjusting the length of the sole body in the foot width direction of the sole body. The sole body includes an upper midsole and a lower midsole. The lower midsole is provided with a groove and a slack portion which is disposed in the groove (see FIGS. 7A-1 and 7A-2). The groove is formed so that inner wall surfaces of the groove can be caused to come close to, and separate from, each other in a foot width direction with the adjustment mechanism. The slack portion is provided with the groove.

SUMMARY

In the sole structure of U.S. Patent Application Publication No. 2017/0188655, when the inner wall surfaces of the groove are caused to come close to each other with the adjustment mechanism from a state in which the inner wall surfaces are separated from each other, the slack portion is locally compressively deformed from a root portion connected to the groove. As a result, a restoring force is generated in the portion that has been locally compressively deformed, generating a large resistance by the adjustment mechanism in the sole body. Hence, in the sole structure of U.S. Patent Application Publication No. 2017/0188655, such resistance in motion keeps the adjustment mechanism from smoothly adjusting the length of the sole body in the foot width direction.

In view of the foregoing background, the present disclosure attempts to enable smooth adjustment of a length of a sole body in a foot width direction with an adjustment mechanism.

A first aspect of the present disclosure is directed to a sole structure for a shoe. The sole structure includes: a sole body made of an elastic material; and an adjustment mechanism provided in an intermediate portion of the sole body in a thickness direction, and capable of adjusting a length of the sole body in a foot width direction. The sole body includes: a groove formed such that inner wall surfaces of the groove are caused to come close to, and separate from, each other in the foot width direction with the adjustment mechanism, and foot width direction between the inner wall surfaces of the groove, and elastically transformable. The transformable portion includes: a pair of rising portions which are continuous with the inner wall surfaces of the groove and extend in the thickness direction of the sole body while the inner wall surfaces have come close to each other, and a coupling portion that couples the rising portions to each other at one end. A first cavity is provided between the inner wall surfaces of the groove and the rising portions, while a second cavity is provided between the rising portions.

According to the first aspect, when the adjustment mechanism causes the inner wall surfaces of the groove to come close to each other, the transformable portion is transformed toward the first cavity. On the other hand, when the adjustment mechanism separates the inner wall surfaces away from each other, the transformable portion is transformed toward the second cavity. In other words, the transformable portion can be transformed toward one of the first and second cavities in accordance with the approaching or separating movement of the inner wall surfaces of the groove caused by the adjustment mechanism. As a result, an excessive stress is less likely to concentrate to the root portion of the groove and the transformable portion when the length of the sole body in the foot width direction is adjusted with the adjustment mechanism.

This results in a decrease in a resistance in motion generated in the sole body when the length of the sole body in the foot width direction is adjusted. Thus, the first aspect enables smooth adjustment of the length of the in the foot width direction with the adjustment mechanism.

A second aspect of the present disclosure is an embodiment of the first aspect. In the second aspect, the transformable portion is configured to transform greater than stretch of the sole body in the foot width direction caused by the adjustment mechanism According to the second aspect, since the transformable portion is configured to transform greater than stretch of the sole body in the foot width direction caused by the adjustment mechanism, the resistance in motion is less likely to be generated by the adjustment mechanism. This feature enables smoother adjustment of the length of the sole body in the foot width direction with the adjustment mechanism.

A third aspect of the present disclosure is an embodiment of the first aspect. In the third aspect, the rising portions extend upright in the thickness direction of the sole body while the inner wall surfaces of the groove have come close to each other.

According to the third aspect, the rising portion is easily transformed toward the first cavity when the inner wall surfaces are caused to come close to each other by the adjustment mechanism. Further, when the adjustment mechanism separates the inner wall surfaces away from each other, the rising portion is easily transformed toward the second cavity. This feature reduces the above resistance generated by the adjustment mechanism, and enables smoother adjustment of the length of the sole body in the foot width direction with the adjustment mechanism.

A fourth aspect of the present disclosure is directed to a shoe including the sole structure of any one of the first to third aspects.

According to the fourth aspect, shoes may be provided which are as advantageous as the first to third aspects.

As described above, the present disclosure enables smooth adjustment of the sole body in the foot width direction with the adjustment mechanism.

DETAILED DESCRIPTION

Embodiments of the present disclosure will now be described with reference to the drawings. Note that the following description of the embodiments is merely an example in nature, and is not intended to limit the scope, applications, or use of the present disclosure.

Figure 1:
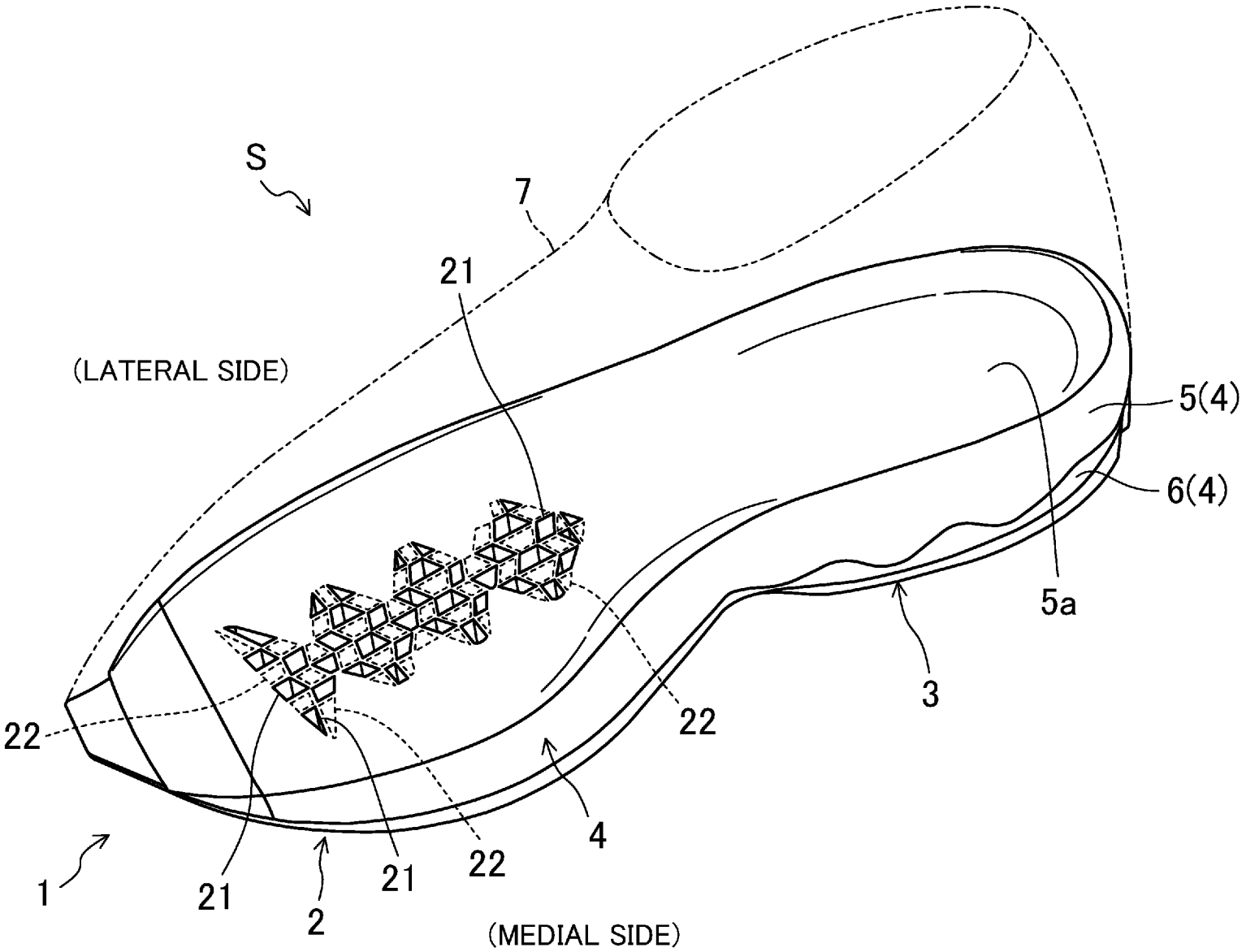
FIG. 1 is a perspective view illustrating an overall configuration of a sole structure according to an embodiment of the present disclosure and a shoe including the sole structure.

FIG. 1 is an overall view of a sole structure 1 according to an embodiment of the present disclosure. A pair of shoes S including the sole structure 1 may be used, for example, as athletic shoes for running and various sports, sneakers for daily use, or rehabilitation shoes.

The drawings show the sole structure 1 for a right shoe only. A sole structure for a left shoe is symmetrical to the sole structure 1 for the right shoe. In the following description, only the sole structure 1 for the right shoe will be described and the description of the sole structure for the left shoe will be omitted.

In the following description, the expressions "above," "upward," "on a/the top of," "below," "under," and "downward," represent the vertical positional relationship between components of the sole structure 1. The expressions "front," "fore," "forward, "rear," "back," "hind," "behind," and "backward" represent the positional relationship in the longitudinal direction between components of the sole structure 1. Further, a "medial side" and a "lateral side" represent the positional relationship of the sole structure 1 in the foot width direction.

(Sole Body)

As illustrated in FIGS. 1 to 4, the sole structure 1 includes a sole body 2 made of an elastic material. The sole body 2 includes an outsole 3 and a midsole 4.

Figure 3:
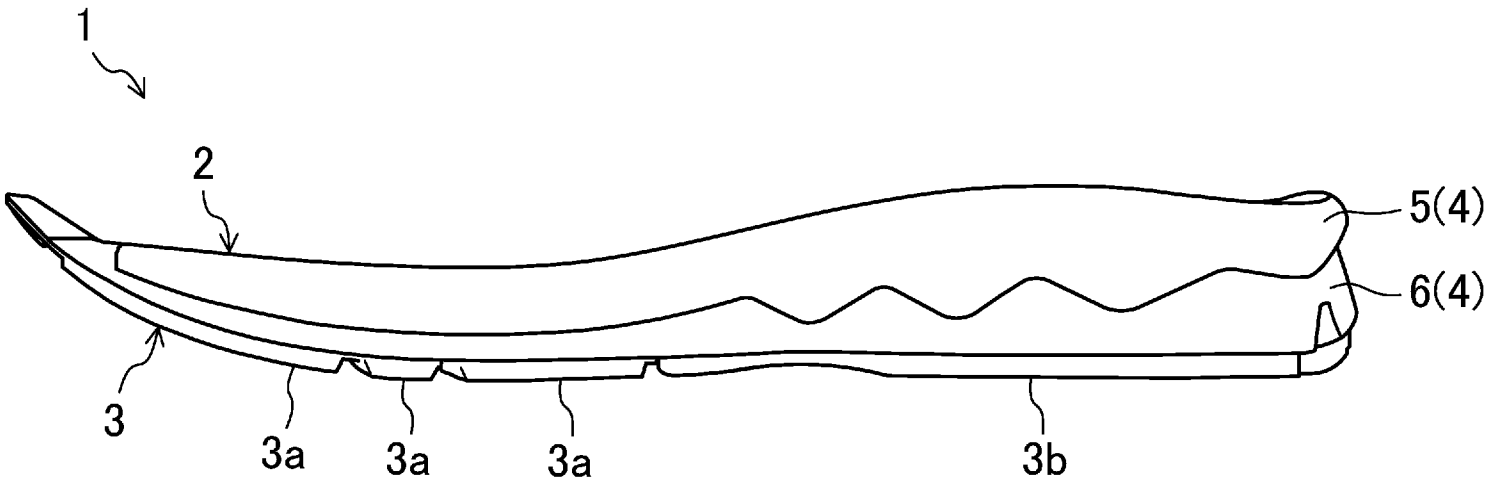
FIG. 3 is a side view of the sole structure, as viewed from a medial side.
Figure 4:
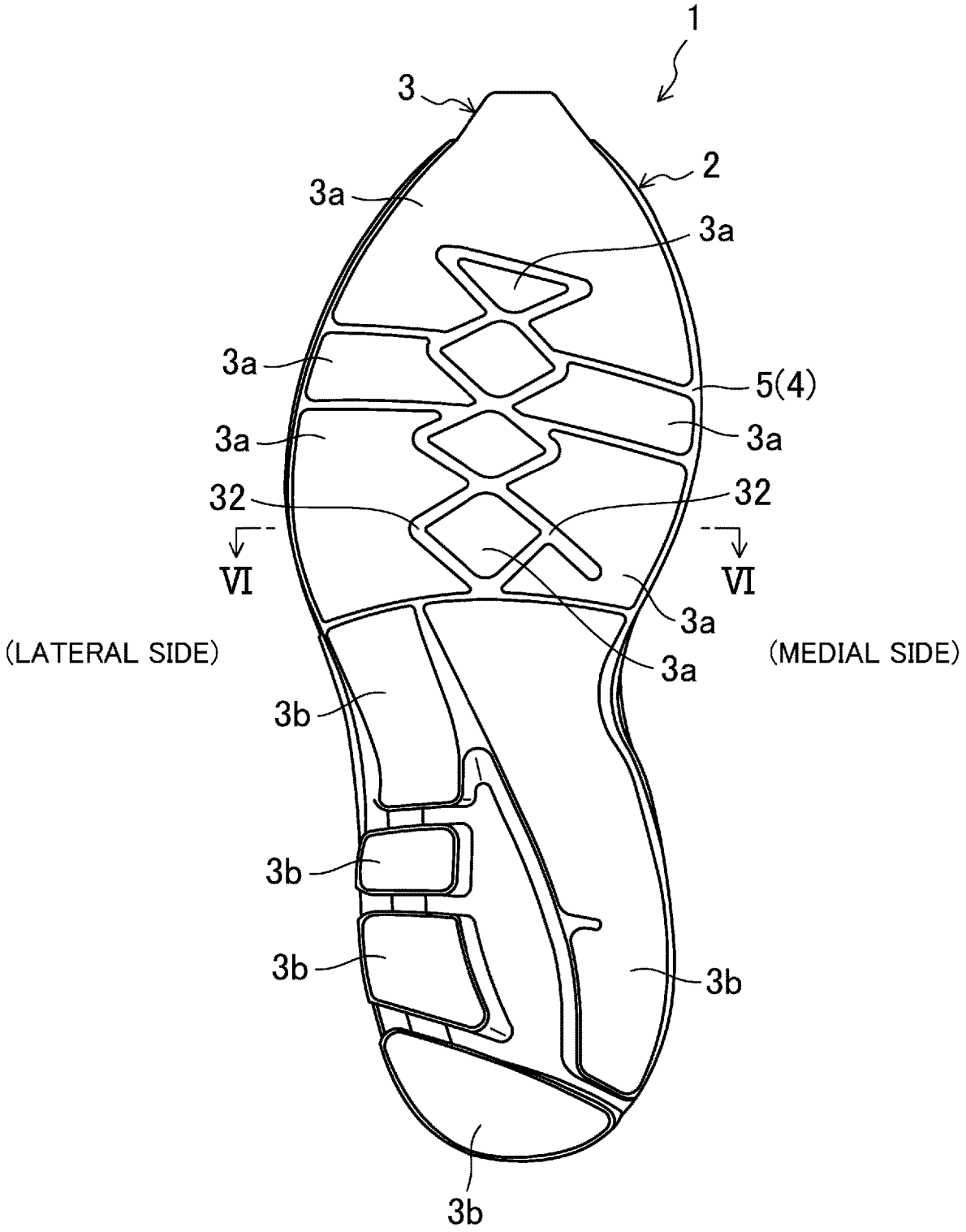
FIG. 4 is a bottom view of the sole structure.

As illustrated in FIGS. 3 and 4, the outsole 3 corresponds to a region of a foot of a wearer, the region extending from a forefoot to a hindfoot. The outsole 3 is made of a hard elastic material which is harder than the material for the midsole 4. Examples of materials suitable for the outsole 3 include, but not are limited to, thermoplastic resins such as ethylene-vinyl acetate copolymer (EVA), thermosetting resins such as polyurethane (PU), and rubber materials such as butadiene rubber and chloroprene rubber.

The outsole 3 is composed of fore outsole components 3*a*, 3*a*, . . . which support a region of the wearer's foot extending from the forefoot to a fore portion of the midfoot, and a hind outsole components 3*b*, 3*b*, . . . which support a region of the wearer's foot extending from a hind portion of the midfoot to the hindfoot. The fore outsole components 3*a* are arranged where deformable portions 32 are not present. The deformable portions 32 will be described later.

As illustrated in FIGS. 1 to 4, the midsole 4 is configured to support the entire planta of the wearer's foot. The midsole 4 is made of a soft elastic material. Examples of the material suitable for the midsole 4 include, but are not limited to, thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials.

The midsole 4 is stacked over the upper side of the outsole 3. A shoe upper 7 which covers the wearer's foot is attached to a peripheral portion of the midsole 4 (see phantom lines in FIG. 1).

The midsole 4 is divided in the vertical direction. Specifically, the midsole 4 has an upper midsole 5, and a lower midsole 6 stacked below the upper midsole 5. A planta support surface 5*a* configured to support the entire planta of the wearer's foot is formed on the upper surface of the upper midsole 5. Note the lower midsole 6 is stacked on the upper side of the outsole 3 by, for example, spraying PU. The spray PU method is a method in which polyurethane (PU) is sprayed onto a mold (not shown) by means of a spray so that a sole is stacked without a defect in a corner portion of the mold or a thin portion of the sole.

Figure 6:
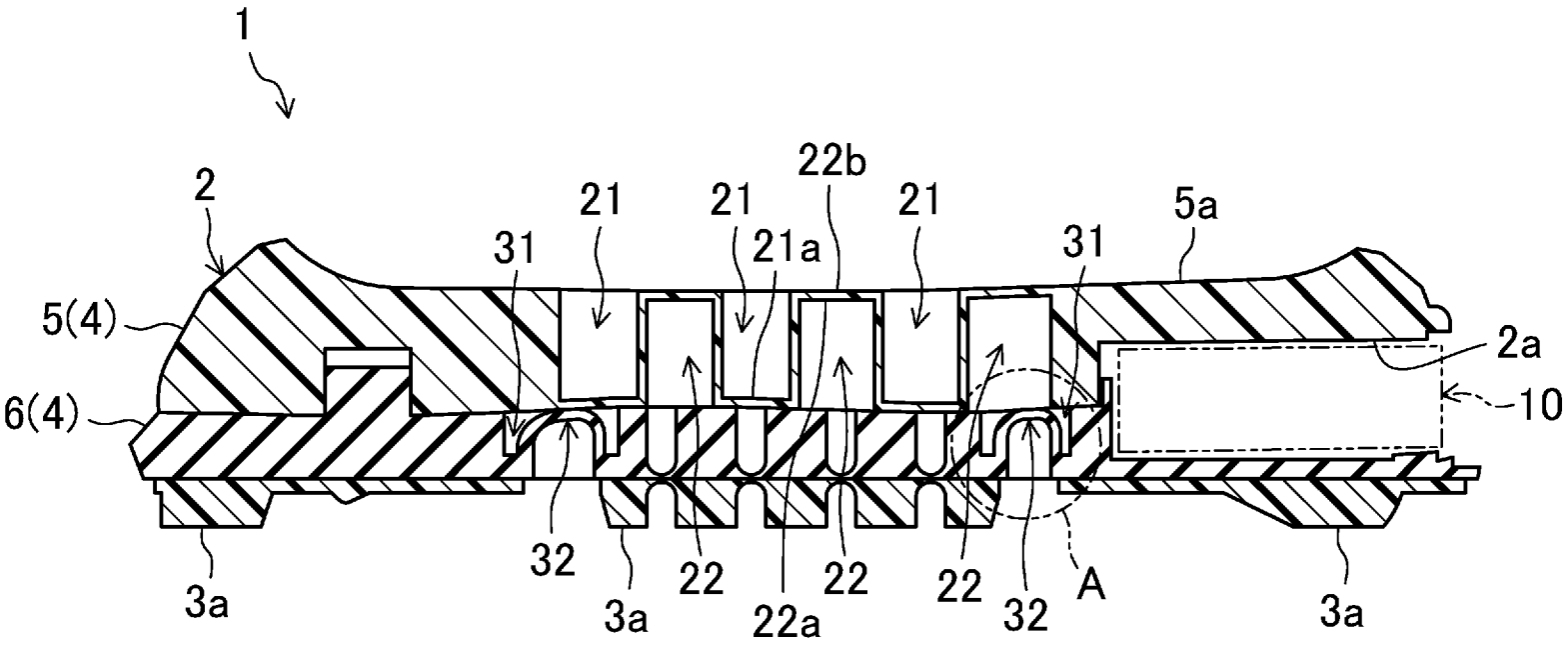
FIG. 6 is a cross-sectional view taken along line VI-VI in FIG. 4.

As illustrated in FIG. 6, the sole body 2 is provided with a housing portion 2*a* for housing an adjustment mechanism 10 at a position corresponding to the forefoot of the wearer's foot. The adjustment mechanism 10 will be described later. The housing 2*a* is formed as a space between the upper midsole 5 and the lower midsole 6. Note that FIG. 6 shows only part of the housing portion 2*a*, which is configured to house components of the adjustment mechanism 10, namely, a paddle 11, a body 13, and a first anchor 14, which will be described later.

(Adjustment Mechanism)

Figure 2:
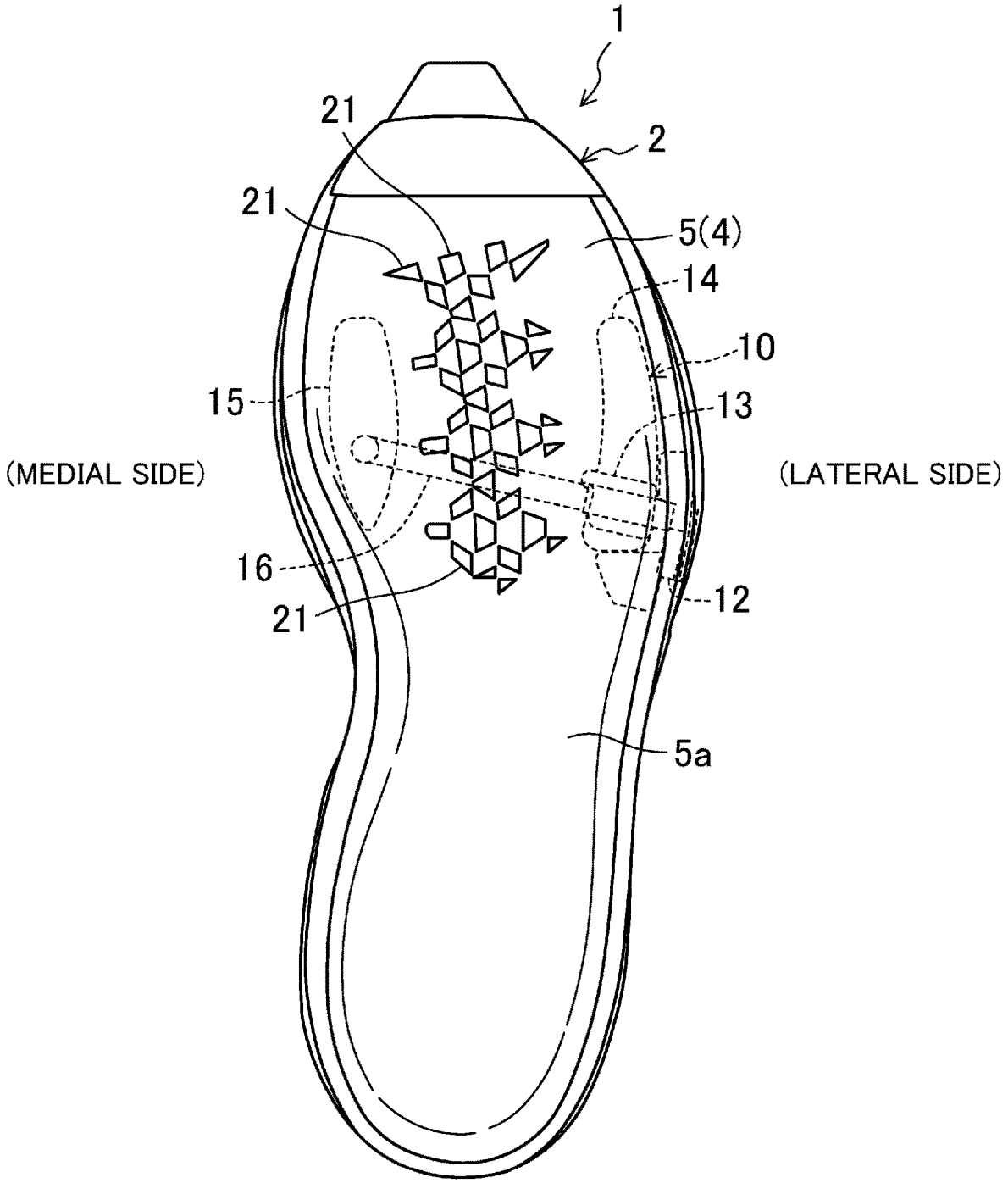
FIG. 2 is a top view of the sole structure.

Reference is now made to FIG. 2. As illustrated in FIG. 2, the adjustment mechanism 10 configured to adjust a length of the sole body 2 in the foot width direction is provided in an intermediate portion of the sole body 2 in the thickness direction. The adjustment mechanism 10 is housed in the housing 2*a* of the sole body 2. Specifically, the adjustment mechanism 10 is provided in the sole body 2 and positioned to correspond to the forefoot including metatarsophalangeal joints (hereinafter referred to as the MP joints) of the wearer's foot.

Figure 5:
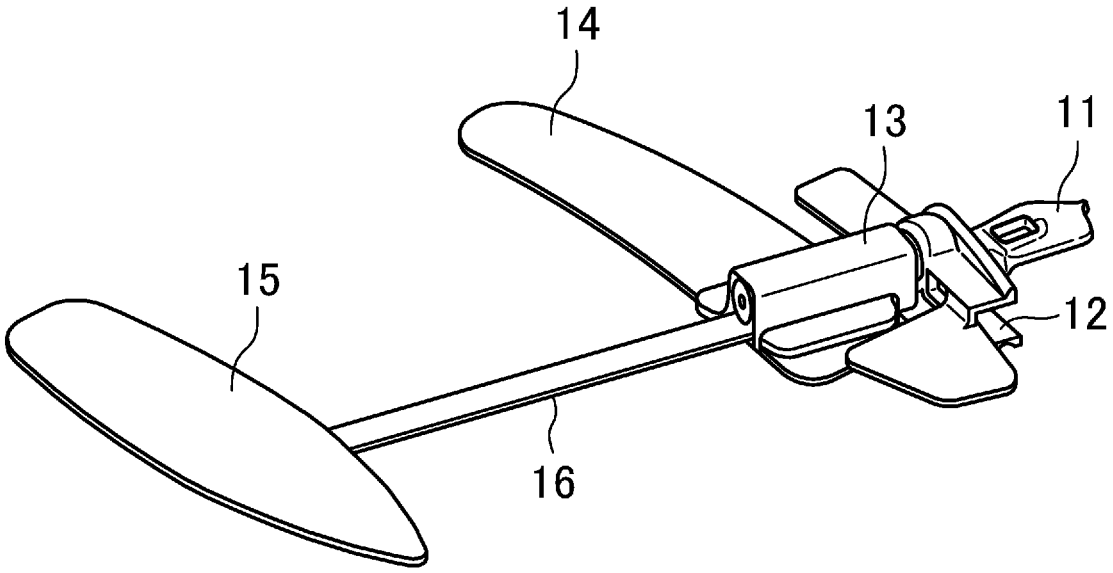
FIG. 5 is a perspective view illustrating an overall configuration of an adjustment mechanism.

As illustrated in FIG. 5, the adjustment mechanism 10 is comprised mainly of the paddle 11, a paddle housing portion 12, the body 13, the first anchor 14, a second anchor 15, and an actuation strap 16.

The paddle 11 is disposed at a position in the sole body 2, the position adjacent to the lateral side. The paddle 11 is rotatably coupled to the body 13. As illustrated in FIG. 2, the paddle 11 is housed in the puddle housing 12. In this housed state, the paddle 11 is not rotatable with respect to the body 13. Specifically, in the housed state illustrated in FIG. 2, the length of the sole body 2 in the foot width direction is maintained at a predetermined length. In contrast, in a state illustrated in FIG. 5, the paddle 11 is exposed from the paddle housing 12 toward the lateral side of the sole body 2. In this state, the paddle 11 can be rotationally operated with respect to the body 13.

The first anchor 14 is mounted to the the lower side of the body 13 and is stationary with respect to the sole body 2. On the other hand, the second anchor 15 is arranged at a position, in the sole body 2, adjacent to the medial side. The second anchor 15 is movable in the foot width direction of the sole body 2.

The actuation strap 16 has a substantially rectangular shape and extends in the foot width direction. The actuation strap 16 has an end located adjacent to the lateral side and coupled to a lead screw (not shown) incorporated in the body 13, and an end located adjacent to the medial side coupled to the second anchor 15.

It is described next how the adjustment mechanism 10 operates. When the paddle 11 is rotated, the lead screw of the body 13 rotates. The rotation of the lead screw causes the actuation strap 16 to stretch and contract in the foot width direction. The stretch and contraction of the actuation strap 16 causes the second anchor 15 to move in the foot width direction. The length of the sole body 2 in the foot width direction can be adjusted through this sequential operation of the adjustment mechanism 10.

(First Recesses and Second Recesses)

As illustrated in FIG. 1, the upper midsole component 5 of the sole body 2 has first recess 21, 21, . . . and second recesses 22, 22, . . . The first and second recesses 21, 22, are provided in an area, of the upper midsole component 5, corresponding to the forefoot of the wearer's foot including the MP joints. Note that for the sake of convenience, the second recesses 22, 22, . . . are omitted from the FIG. 2.

The first recesses 21, 21, . . . are arranged at intervals. Each first recess 21 is configured so as to have a micro opening in plan view. In this embodiment, each first recess 21 has an opening in the shape of a micro triangle or a micro quadrangle. As a result, even if the first recesses 21, 21, . . . come into contact with the planta of the wearer's foot, the wearer does not feel the presence of the first recesses 21, 21, . . . , which has the micro openings, reducing a local stimulus to the planta. As a result, discomfort to the planta of the wearer's foot can be reduced.

As illustrated in FIG. 6, each first recess 21 is formed through recessing the planta support surface 5*a* of the upper midsole component 5 in the downward direction. In other words, each first recess 21 has a bottom 21*a* in its lower portion. On the other hand, each second recess 22 is recessed from the lower surface of the upper midsole 5 in the upward direction. In other words, each second recess 22 has a bottom 22*a* in its upper portion. The bottoms 21*a*, 22*a* keep foreign objects from coming through the outsole 3 toward the planta support surface 5*a* of the upper midsole 5.

In the sole body 2, in a position where an adjustment mechanism 10 is not interposed between the upper and lower midsole components 5, 6, the bottom 21*a* of each first recess 21 is in contact with the upper surface of the lower midsole component 6. Each second recess 22 has a top surface 22*b* that is opposite to the bottom 22*a* and coplanar with the planta support surface 5*a* of the upper midsole component 5.

The first and second recesses 21, 22 are alternately and continuously formed in the foot width direction. In other words, the first and second recesses 21, 22 are formed to have a bellow structure which can be expanded and contracted in the foot width direction. As a result, a resistance is less likely to be generated by the adjustment mechanism 10 at least in the upper midsole 5 when the length of the sole body 2 in the foot width direction is adjusted with the adjustment mechanism 10. This feature enables smooth adjustment of the length of the sole body 2 in the foot width direction with the adjustment mechanism 10. Beneficially, each of the first and second recesses 21, 22 have a thickness of 1 mm to 2 mm.

(Grooves and Transformable Portions)

As illustrated in FIG. 6, the lower midsole 6 of sole body 2 is provided with grooves 31, 31 and transformable portions 32, 32. This configuration constitutes a feature of the present disclosure. The grooves 31 and the transformable portions 32 are provided in an area, of the lower midsole 6, corresponding to the forefoot of the wearer's foot including the MP joints (see FIG. 4). The transformable portions 32, 32 each have the shape of a substantial triangle or a substantial rhombus in bottom view and are continuously arranged in the longitudinal direction. However, this is merely a non-limiting example. The transformable portions 32 may have a shape chosen from various shapes.

Figure 7:
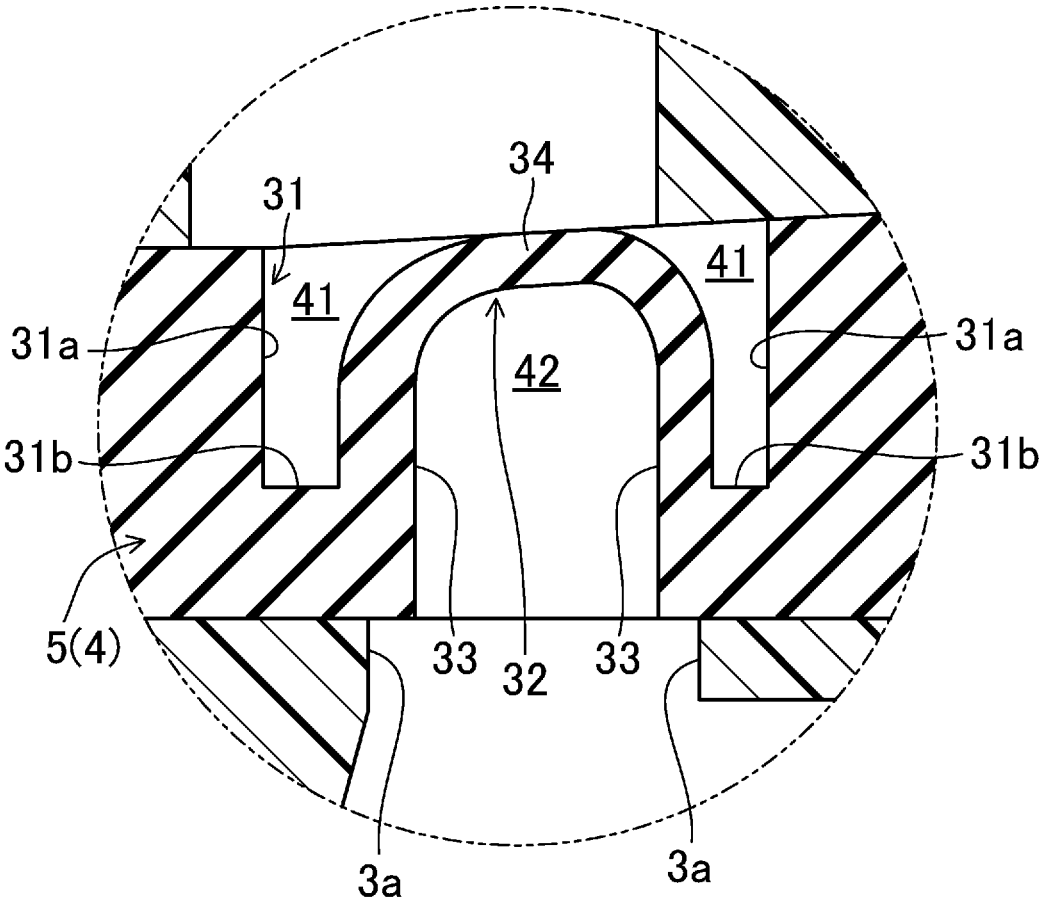
FIG. 7 is an enlarged partial view showing the portion A of FIG. 6.
Figure 8:
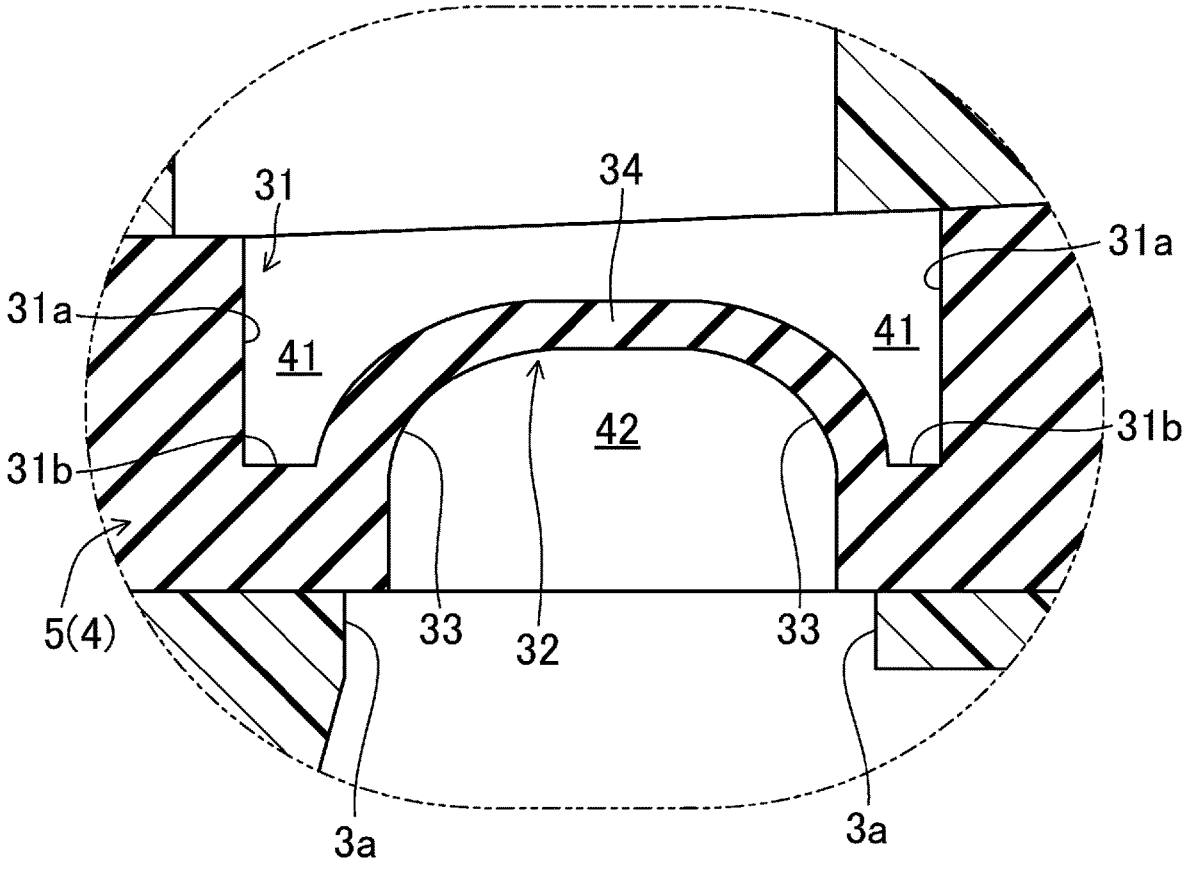
FIG. 8 corresponds to FIG. 7, and illustrates a state of a groove and a deformable portion when the length of a sole body in the foot width direction is increased by an adjustment mechanism.

As illustrated also in FIGS. 7 and 8, each groove 31 is recessed from the upper surface of the lower midsole 6 in a downward direction. The groove 31 is configured such that the inner wall surfaces 31*a*, 31*a* are caused to come close to, and separate from, each other in the foot width direction with the adjustment mechanism 10.

Each transformable portion 32 is provided in an associated one of the grooves 31. The transformable portion 32, which extends in the foot width direction between the inner wall surfaces 31*a*, 31*a* of the groove 31, is formed integrally with the lower midsole 6. The transformable portion 32 is loose when the inner wall surfaces 31*a*, 31*a* of the grooves 31 come close to each other (see FIGS. 6 and 7). Specifically, each transformable portion 32 has an inverted U-shape in cross-sectional view. The transformable portion 32 is elastically transformable and is configured to transform greater than stretch of the sole body 2 in the foot width direction caused with the adjustment mechanism 10.

The transformable portion 32 has a pair of rising portions 33, 33. Each of the rising portions 33 is integrally formed with the groove 31 such that ends of the rising portion 33 located adjacent to the outsole 3 at one end are continuous with an inner wall surface 31*a* of the groove 31 via the bottom portion 31*b* of the groove 31. Beneficially, the rising portions 33 have a thickness of 1 mm to 2 mm.

The rising portions 33 extend in the vertical direction (i.e., in the thickness direction of the sole body 2) while the inner wall surfaces 31*a*, 31*a* of the groove 31 have come close to each other (see FIGS. 6 and 7). More specifically, the rising portions 33 extend upright from the bottom portion 31*b* of the groove 31.

Each transformable portion 32 has a coupling portion 34 that couples the rising portions 33, 33 to each other. In this embodiment, the coupling portion 34 is curved upward from the other end of each rising portion 33. Specifically, the coupling portion 34 is formed such that the upper surface of the coupling portion 34 becomes coplanar with the upper surface of the lower midsole component 6 in the state where the inner wall surfaces 31*a*, 31*a* of the groove 31 have come close to each other (see FIGS. 6 and 7). It is preferable that the coupling portion 34 have a thickness of 1 mm to 2 mm.

A first cavity 41 is provided between the inner wall surfaces 31*a* of the groove 31 and the rising portions 33, 33. On the other hand, a second cavity 42 is provided between the rising portions 33, 33. When the adjustment mechanism 10 causes the inner wall surfaces 31*a*, 31*a* of the groove 31 to come close to each other from the state where the inner wall surfaces 31*a*, 31*a* are separated away from each other (see FIG. 8), the transformable portion 32 (in particular, the rising portions 33, 33) moves toward the first cavity 41 while transforming (see FIG. 7). In contrast, when the adjustment mechanism 10 separates the inner wall surfaces 31*a*, 31*a* away from each other from the state where the inner wall surfaces 31*a*, 31*a* are close to each other (see FIG. 8), the transformable portion 32 (in particular, the rising portions 33, 33) moves toward the second cavity 42 while transforming (see FIG. 7).

[Advantages of Embodiment]

As can be seen, in the sole structure 1, the transformable portion 32 includes the rising portions 33, 33 and the coupling portion 34, the first cavity 41 is provided between the inner wall surface 31*a* of the groove 31 and each rising portion 33, and the second cavity 42 is provided between the rising portions 33, 33. With this configuration, when the adjustment mechanism 10 causes the inner wall surfaces 31*a*, 31*a* of the groove 31 to come close to each other, the transformable portion 32 is transformed toward the first cavity 41. In contrast, when the adjustment mechanism 10 separates the inner wall surfaces 31*a*, 31*a* away from each other, the transformable portion 32 is transformed toward the second cavity 42. In other words, the transformable portion 32 can be transformed toward one of the first and second cavities 41, 42 in accordance with the approaching or separating movement of the inner wall surfaces 31*a*, 31*a* of the groove 31 caused by the adjustment mechanism 10. As a result, an excessive stress is less likely to concentrate on the root portion of the groove 31 and the transformable portion 32 when the length of the sole body 2 in the foot width direction is adjusted with the adjustment mechanism 10. This results in a decrease in a resistance generated by the adjustment mechanism 10 in the sole body 2 when the length of the sole body 2 in the foot width direction is adjusted. Thus, the sole structure 1 according to the embodiment of the present disclosure enables smooth adjustment of the length of the sole body 2 in the foot width direction with the adjustment mechanism 10.

The transformable portion 32 is configured transform greater than stretch of the sole body 2 in the foot width direction caused by the adjustment mechanism 10. This feature reduces the above resistance generated by the adjustment mechanism 10, and enables smoother adjustment of the length of the sole body 2 in the foot width direction by the adjustment mechanism 10.

The rising portions 33, 33 extend upright in the thickness direction while the inner wall surfaces 31*a*, 31*a* of the groove 31 have come close to each other. Therefore, the rising portion 33 is easily transformed toward the first cavity 41 when the inner wall surfaces 31*a*, 31*a* are caused to come close to each other by the adjustment mechanism 10. Further, the rising portion 33 is easily transformed toward the second cavity 42 when the inner wall surfaces 31*a*, 31*a* are separated from each other with the adjustment mechanism 10. This feature reduces the above resistance generated by the adjustment mechanism 10, and enables smoother adjustment of the length of the sole body 2 in the foot width direction with the adjustment mechanism 10.

[Other Embodiments]

In the embodiment described above, the adjustment mechanism 10 is disposed at a position, in the sole body 2, corresponding to the forefoot of the wearer's foot. However, this is merely a non-limiting example.

For example, the adjustment mechanism 10 may be disposed at a position, in the sole body 2, corresponding to the midfoot of the wearer's foot. Alternatively, the adjustment mechanism 10 may be disposed at a position, in the sole body 2, corresponding to both the forefoot and the midfoot of the wearer's foot. In these embodiments, the first recesses 21, the second recesses 22, the grooves 31, and the deformable portions 32 may suitably be disposed in correspondence with the position of the adjustment mechanism 10.

Figure 9:
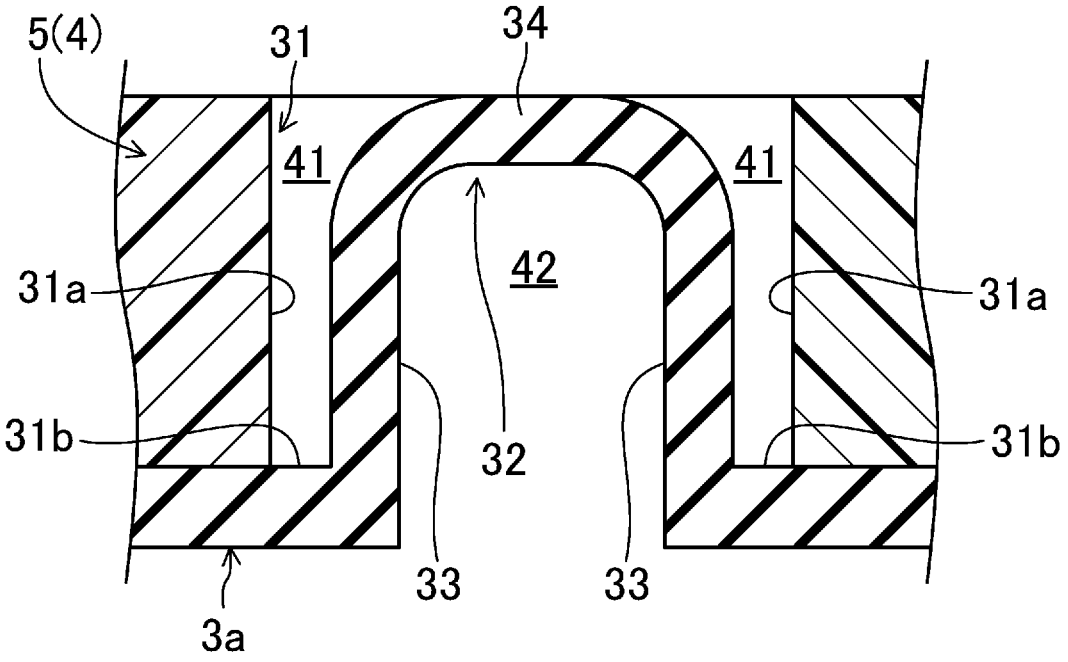
FIG. 9 is a longitudinal cross-sectional view of a sole structure according to another embodiment.

In the embodiment described above, the grooves 31 and the transformable portions 32 are provided in the lower midsole 6. However, this is merely a non-limiting example. For example, as illustrated in FIG. 9, the grooves 31 and the transformable portions 32 may be provided in the fore outsole 3*a* (the outsole 3). This configuration also can provide the same advantages as provided by the embodiment described above.

In the embodiment above, the deformable portions 32 is formed integrally with the grooves 31 of the lower midsole component 6. However, this is merely a non-limiting example. The deformable portion 32 may be provided as a separate member and may be fixed to the groove 31 of the lower midsole component 6.

In the embodiment described above, the deformable portion 32 had an inverted U-shape. However, this is merely a non-limiting example. The deformable portion 32 may have a shape chosen from various shapes. For example, the transformable portion 32 may have an inverted V-shape. Alternatively, the deformable portion 32 may have a U-shape or a V-shape.

In the embodiment described above, each first recess 21 has the shape of a micro triangle or a micro quadrangle. However, this is merely a non-limiting example. For example, each of the first recesses 21 may have an opening in such a polygonal shape as a square or a hexagon. Alternatively, each of the first recesses 21 may have an opening in the shape of a circle. Alternatively each of the first recesses 21 may have an opening formed as a slot which extends in the longitudinal direction. A width of the slot in the foot width direction is shorter than a length thereof in the longitudinal direction. Note that, each of the second recesses 22 preferably has a downward opening shaped in a similar manner to that of the first recess 21.

Note that the present disclosure is not limited to the embodiment described above, and various changes and modifications may be made without departing from the scope of the present disclosure.

The present disclosure is industrially usable as a sole structure of, for example, athletic shoes, and as shoes including the sole structure.

What is claimed is:

1. A sole structure for a shoe, the sole structure comprising:

a sole body made of an elastic material; and an adjustment mechanism provided in an intermediate portion of the sole body in a thickness direction, and capable of adjusting a length of the sole body in a foot width direction, wherein the sole body includes:

a groove formed such that inner wall surfaces of the groove are caused to come close to, and separate from, each other in the foot width direction with the adjustment mechanism, and a transformable portion provided in the groove, extending in the foot width direction between the inner wall surfaces of the groove, and elastically transformable, the transformable portion includes:

a pair of rising portions which are continuous with the inner wall surfaces of the groove and extend in the thickness direction while the inner wall surfaces have come close to each other, and a coupling portion that couples the rising portions to each other at one end, and a first cavity is provided between the inner wall surfaces of the groove and the rising portions, while a second cavity is provided between the rising portions.

2. The sole structure of claim 1, wherein the transformable portion is configured to transform greater than stretch of the sole body in the foot width direction caused by the adjustment mechanism.

3. The sole structure of claim 1, wherein the rising portions extend upright in the thickness direction while the inner wall surfaces of the groove have come close to each other.

4. A shoe comprising the sole structure of claim 1.

5. A shoe comprising the sole structure of claim 2.

6. A shoe comprising the sole structure of claim 3.

* * * * *